US007565973B2

(12) United States Patent
Chang

(10) Patent No.: US 7,565,973 B2
(45) Date of Patent: Jul. 28, 2009

(54) SUSPENSION TAG FOR SOCKET WRENCH

(76) Inventor: Chi-Tsai Chang, No. 39, Sec. 3, Han Kou Rd., Taichung City (TW)

( * ) Notice: Subject to any disclaimer, the term of this patent is extended or adjusted under 35 U.S.C. 154(b) by 301 days.

(21) Appl. No.: 11/743,677

(22) Filed: May 3, 2007

(65) Prior Publication Data

US 2008/0272017 A1 Nov. 6, 2008

(51) Int. Cl.
*B65D 85/28* (2006.01)

(52) U.S. Cl. ..... 206/378; 206/806; 211/70.6; 248/689

(58) Field of Classification Search ..... 206/348, 206/349, 376, 378, 379, 461, 377, 470–495, 206/806; 211/70.6, 69, 113, 115; 248/682, 248/689, 551, 690
See application file for complete search history.

(56) References Cited

U.S. PATENT DOCUMENTS 4,019,632 A * 4/1977 Greenlee ..... 206/349
4,450,961 A * 5/1984 Bies et al. ..... 206/349
5,785,174 A * 7/1998 Chow ..... 206/349
5,897,001 A * 4/1999 Dembicks ..... 211/70.6
6,070,745 A * 6/2000 Dembicks ..... 211/70.6
6,409,015 B1 * 6/2002 Hu ..... 206/378
6,820,742 B1 * 11/2004 Chen ..... 206/378
6,883,767 B1 * 4/2005 Huang ..... 248/317
2008/0029420 A1 * 2/2008 Tong ..... 206/495

* cited by examiner

*Primary Examiner*—Luan K Bui
*Assistant Examiner*—Dene Quest
(74) *Attorney, Agent, or Firm*—Leong C. Lei

(57) ABSTRACT

A suspension tag for a socket wrench is disclosed which provides a measure for easy and secured hanging of the socket wrench. The suspension tag includes a tag body forming a receptacle seat defining a bore to rotatably receive therein a fitting cap. The fitting cap forms a hollow frame section to receive a drive piece of the wrench therein. The hollow frame has an elastically deformable top panel that is connected to side panels in a limited moveability manner. The top panel forms an internal projection that, when brought into contact with the drive piece of the wrench at the time the wrench is inserted into the fitting cap, forces the top panel to deform and displace upward to allow the project to reach and thus engage a hole defined in the drive piece of the wrench that retains a spring-biased sphere therein so as to secure the wrench to the fitting cap and thus the suspension tag.

5 Claims, 6 Drawing Sheets

SUSPENSION TAG FOR SOCKET WRENCH

BACKGROUND OF THE INVENTION (a) Technical Field of the Invention

The present invention relates to a tag for hanging or suspending or exhibiting a tool having a form similar to a socket wrench, wherein a fitting cap is provided, having a receiving space complementary to a drive piece or an end of the tool to allow direct insertion of the tool into the fitting cap and the fitting cap forms an internal projection that, once the end or drive piece of the tool is inserted into the receiving space of the fitting cap and the internal projection gets into contact with the end or the drive piece of the tool, forcibly expands the fitting cap by means of the resiliency of the cap to allow further extension of the end or the drive piece of the tool into the receiving space of the fitting cap and that, at the time the end or the drive piece of the tool is extended into the receiving space to a predetermined extent, is engageable with a hole that is defined in the end or the drive piece of the tool to retain, in a partially projecting but retractable manner, a spring-biased locking sphere so as to secure the tool to the tag; and wherein to remove the tool from the tag, the fitting cap is broken to allow expansion of receiving space thereby realizing easy separation of the tool from the tag.

(b) Description of the Prior Art

It is often to attach a hand tool to a suspension tag for exhibition and security purposes. Such a tag allows for easy inspection of the harsh tool by the general consumers or purchasers to eliminate unnecessary misunderstanding and argument between the sellers and the purchasers. Various exhibition arrangements are available in the market for various tools or tool accessories. For example, sockets of socket wrenches are often packed in a package that allows for easy and independent exhibition and inspection of the sockets. However, heretofore, it is hardly seen any suitable exhibition arrangements for elongate tools or tools having an elongate handle and a bent or angled end piece. The most commonly known packages for such tools are molded casings in which a recess or cavity corresponding in side and shape to the tool is defined. And the tool is received and retained in the recess. Since in the conventional way, a major portion of the tool is covered by the package, visual inspection is not possible for the consumers. The trend of retail or other business activity for the hand tools requires the sellers to exhibit the tools as open as possible to allow the purchasers to visually and directly inspect the tool. Thus, a suspension tag that securely retains and exhibits a tool is needed and the present invention is aimed to provide such a suspension tag.

SUMMARY OF THE INVENTION

The primary purpose of the present invention is to provide a suspension tog comprising an individual plate-like tag body, which forms a receptacle seat defining a bore for releasably receiving insertion of a fitting cap therein and the fitting cap forms a hollow frame section to removably receive a portion of a tool therein, wherein an internal projection is formed on an inside surface of the frame section of the fitting cap to engage a hole defined in the portion of the tool to thereby secure the tool to the fitting cap while the engagement between the bore of the receptacle seat and the fitting cap allows for relative rotation and angularly positioning between the tag and the tool for easy inspection of the tool.

Thus, the primary object of the present invention is to provide a suspension tag comprising an individual tag body defining a bore to receive the insertion of a fitting cap therein in a rotatable and angularly positionable manner so as to form a complete suspension tag assembly. The fitting cap forms a hollow frame section which is configured to fit over a portion of a tool to allow for secure and easy attachment of the tool to the fitting cap thereby realizing anti-theft and easy-operation purpose for the tool.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

Figure 1:
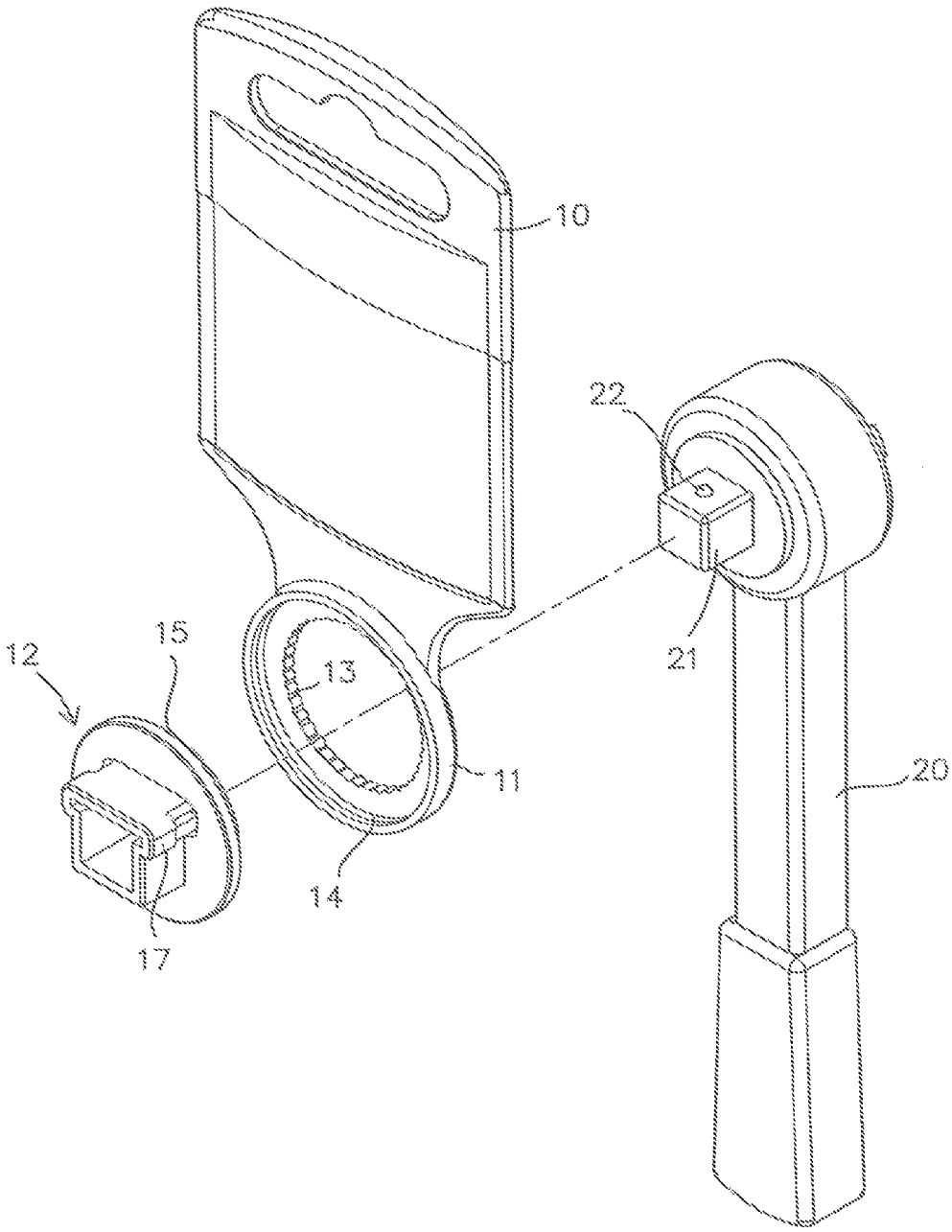
FIG. 1 is an exploded view of a tool suspension tag constructed in accordance with an embodiment of the present invention, together with a tool, such as a socket wrench, to be mounted thereto.
Figure 2:
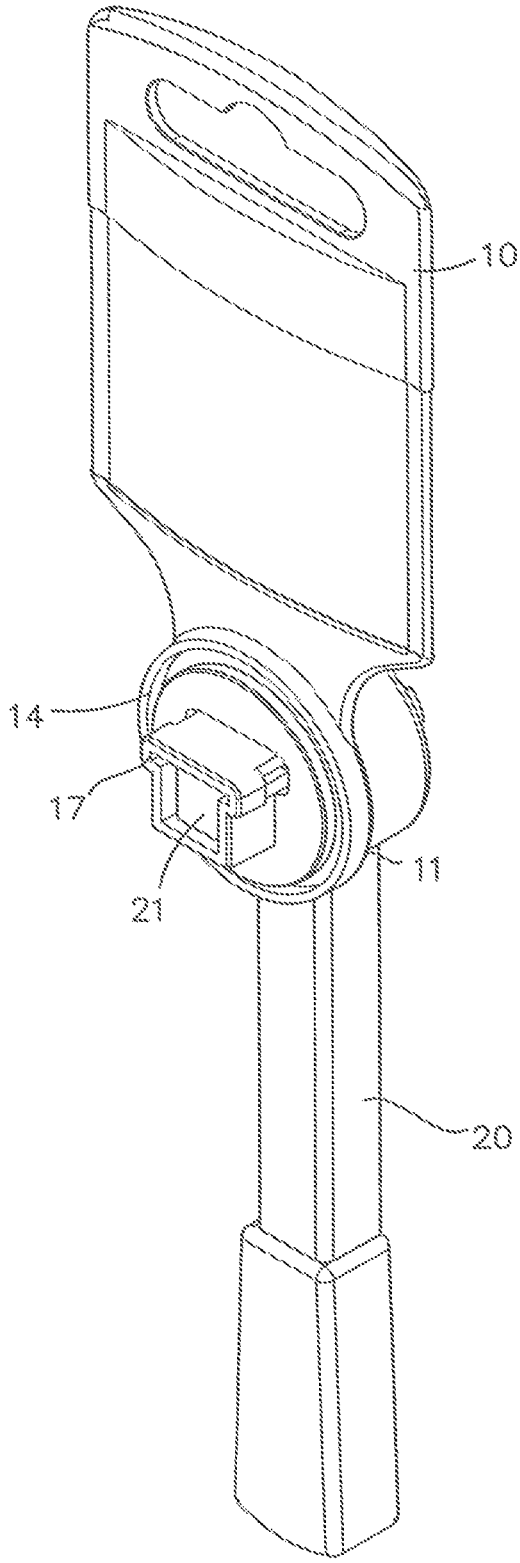
FIG. 2 is a perspective view of the tool suspension tag of the present invention with the tool mounted thereto.
Figure 3:
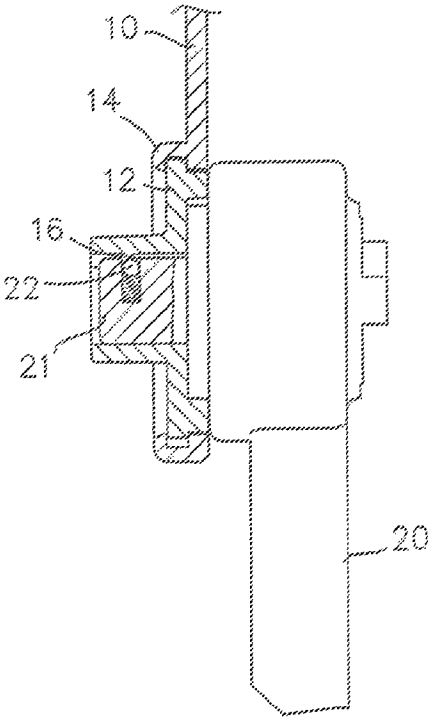
FIG. 3 is a cross-sectional view of the tool suspension tag of the present invention with the tool mounted thereto.

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth, in the appended claims.

With reference to the drawings, and in particular to FIGS. 1-5, a suspension tag for hanging a socket wrench is shown. The suspension tag in accordance with the present invention comprises a plate-like tag body 10, substantially in the form of a rectangle, or if desired, a particular configuration and shape, having a lower edge forming a receptacle seat 11 defining a bore (not labeled) into which a fitting cap 12 is inserted. The bore of the receptacle seat 11 is delimited by a serrated inner circumferential surface 13, on which a plurality of rounded projections or teeth is formed and circumferentially distributed. On an axial end surface of the receptacle seat 11, a circumferential retention flange 14 substantially concentric with the bore is formed. The circumferential flange 14 has a barbed circumferential edge, which projects axially inwards as clearly seen in FIG. 3, whereby when the fitting cap 12 is inserted into the bore of the receptacle seat 11, the fitting cap 12 is engageable with the barbed flange 14 thereby secured in the bore of the receptacle seat 11. Particularly, the fitting cap 12 has a cylindrical section having an outer circumference substantially corresponding to the inside diameter of the bore of the receptacle seat 11 and forms an outward-extending rounded projection 15 that is engageable with the serrated circumferential surface 13 of the bore of the receptacle seat 11 to allow for forcible rotation of the fitting cap 12 with respect to the receptacle seat 11 and also for angularly positioning of the fitting cap 12 with respect to the receptacle seat 11.

The fitting cap 12 has a receiving frame section that is configured to correspond in size and shape to a drive piece 21 of a socket wrench 20 so as to snugly receive the drive piece 21 of the socket wrench 20 therein. The receiving frame section forms a hollow frame having opposite side panels and a top panel, as well as a bottom panel, connecting between the side panels. On an inside surface of the top panel of the receiving frame section of the fitting cap 12, a sloped projection 16 is formed at a location corresponding to a spring-biased locking sphere 22 that is movably received in a blind hole defined in a side surface of the drive piece 21 of the socket wrench 20. Further, the top panel and the side panels of the receiving frame are not connected directly. Particularly, a gap (not labeled) is present between each side panel and the top panel and a curved connection 17 located outboard the side panel connects the side panel to the top panel to provide resiliency and limited displaceability to the top panel. When the drive piece 21 of the socket wrench 20 is fit through the cylindrical section of the fitting cap 12 into the receiving frame section, the sloped projection 16 acts as a cam that forcibly deform/displace the top panel away from the side panels to allow the insertion of the drive piece 21 into the receiving frame section and once the drive piece 21 is sufficiently inserted into the receiving frame section where the sloped projection 16 reaches the hole of the drive piece 21 that retains the spring-biased sphere 22, the sphere 22 is forced against the biasing spring by the projection 16 to allow the projection 16 to partially fit into the hole, under the action of the resiliency of the top panel, thereby securing the socket wrench 20 to the fitting cap 12 and thus the suspension tap. In this situation, with the engagement between the rounded projection 15 of the cylindrical section of the fitting cap 12 and the serrated circumferential surface 13 of the receptacle seat 11, the socket wrench 20 is allowed to rotate to any desired angle for inspection and exhibition. The sloped projection 16 is preferably of a shape corresponding to that of the hole of the socket wrench 20 that receives the sphere 22 to allow proper engagement therebetween.

Figure 7:
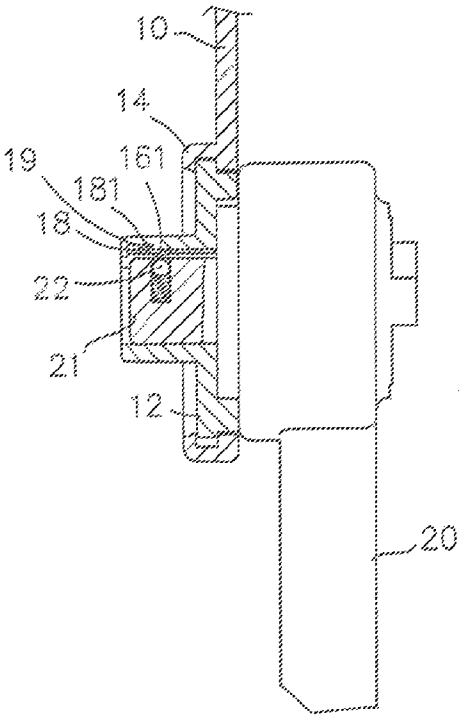
FIG. 7 is a cross-sectional view of the tool suspension tag of the second embodiment of the present invention with the tool mounted therein.
Figure 6:
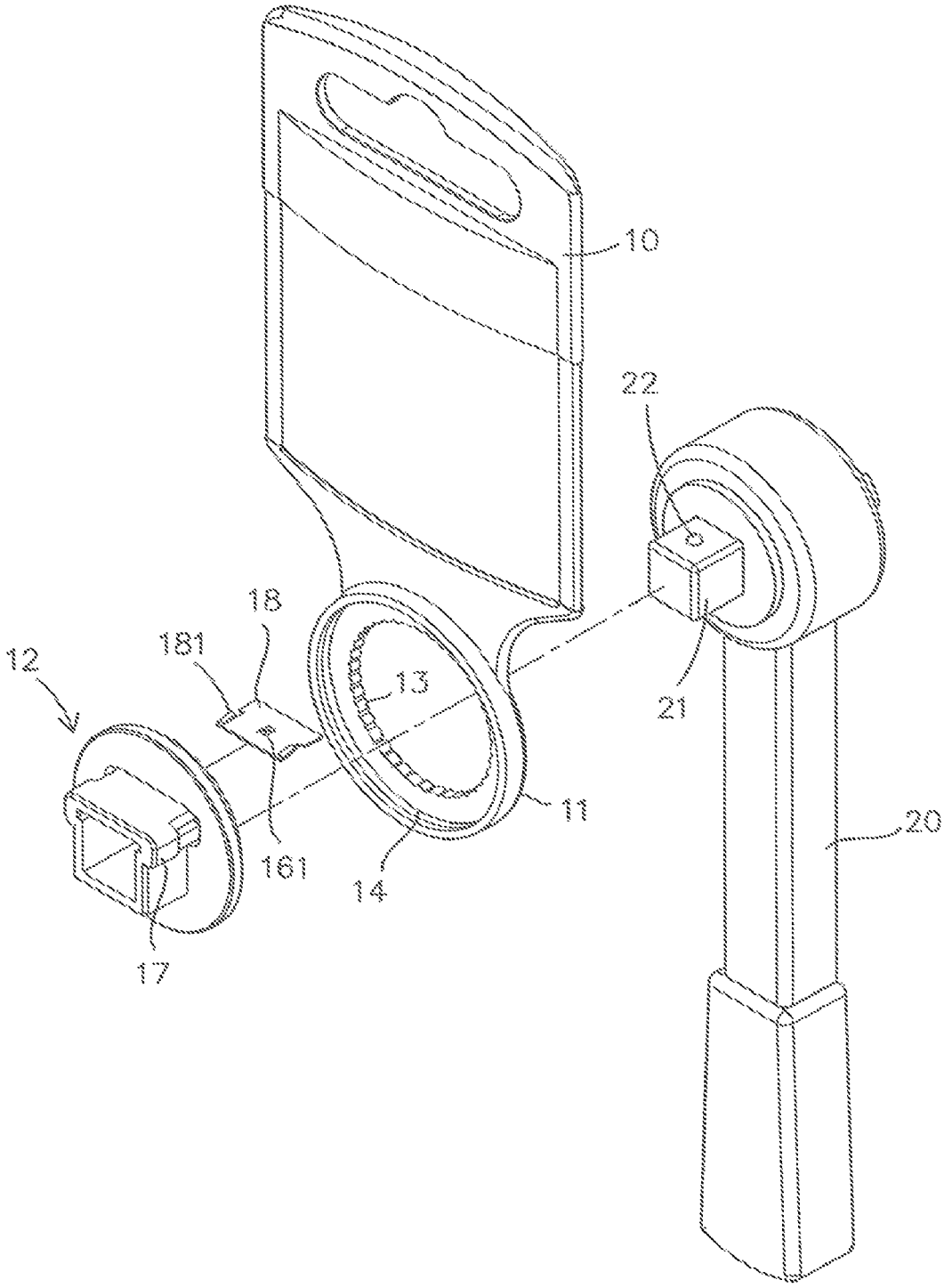
FIG. 6 is an exploded view of a tool suspension tag constructed in accordance with another embodiment of the present invention, together with a tool, such as a socket wrench, to be mounted thereto.

In the embodiment illustrated with reference to FIGS. 1-5, the sloped projection 16 is integrally formed with the top panel of the receiving frame section of the tiding cap 12. However, the sloped protection 16 can be made separately and then fixed inside the receiving frame section of the fitting cap 12, as shown in the embodiment of FIGS. 6 and 7, wherein a plate 18 that is separate from but receivable in the fitting cap 12 is provided. The plate 18, which can be made of any suitable materials, such as metal, forms retention pawls 181 that are engageable with recesses 19 that are defined in an inside surface of the top panel of the receiving frame section of the fitting cap 12 when the plate 18 is received in the fitting cap 12, whereby the plate 18 is securely retained inside the fitting cap 12 and fixed to the top panel. The plate 18 also forms, at a suitable location, a projection 161 that corresponds in position to the spring-biased sphere 22 of the drive piece 21 of the wrench 20 for engaging the hole dint receives the drive piece 21 to thereby secure the wrench 20 to the suspension tag.

Figure 4:
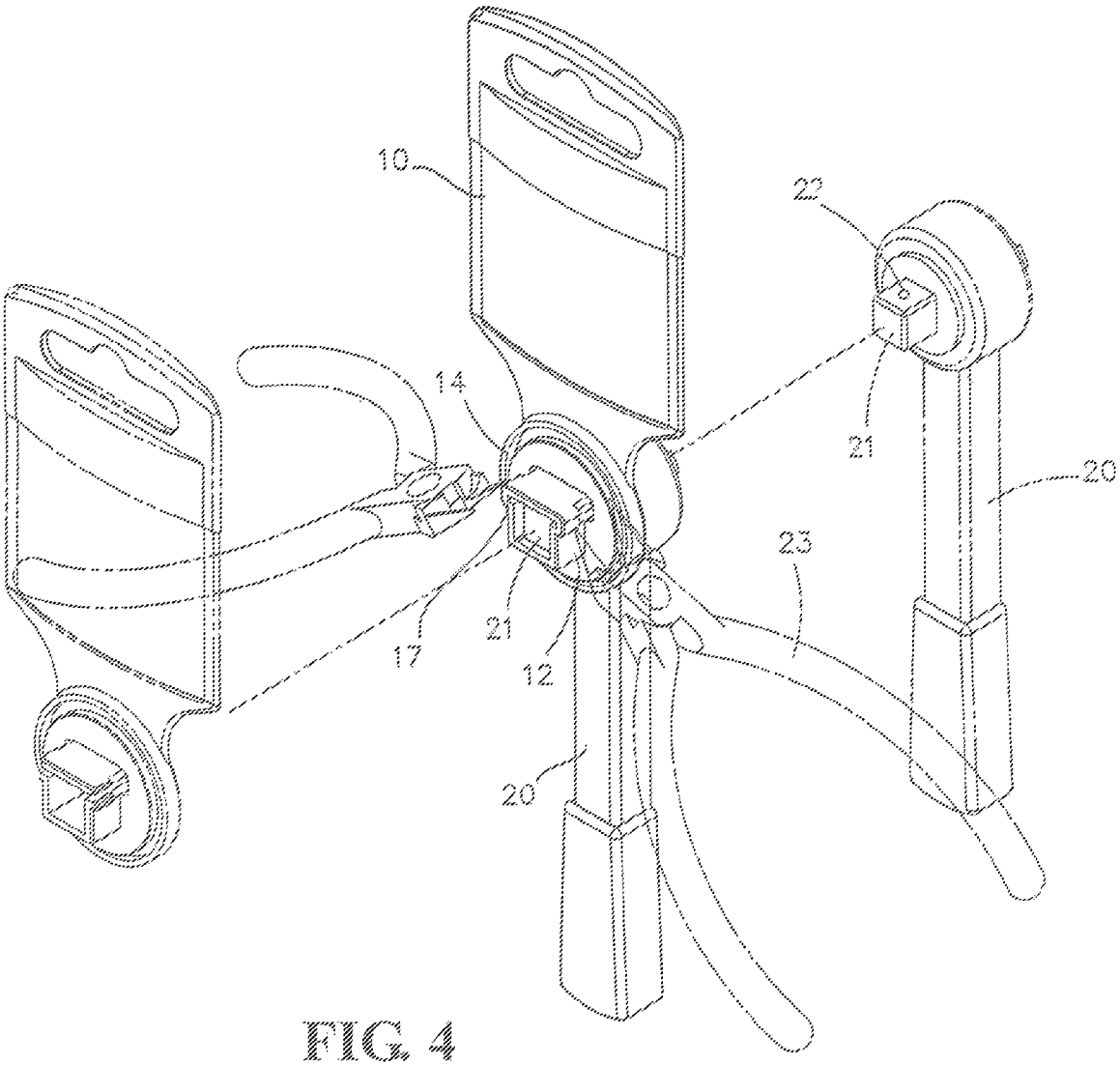
FIG. 4 is a perspective view illustrating using a cutting device to cut off side connections of a frame section of a fitting cap of the suspension tag to facilitate removal of the tool out of the suspension tag.
Figure 5:
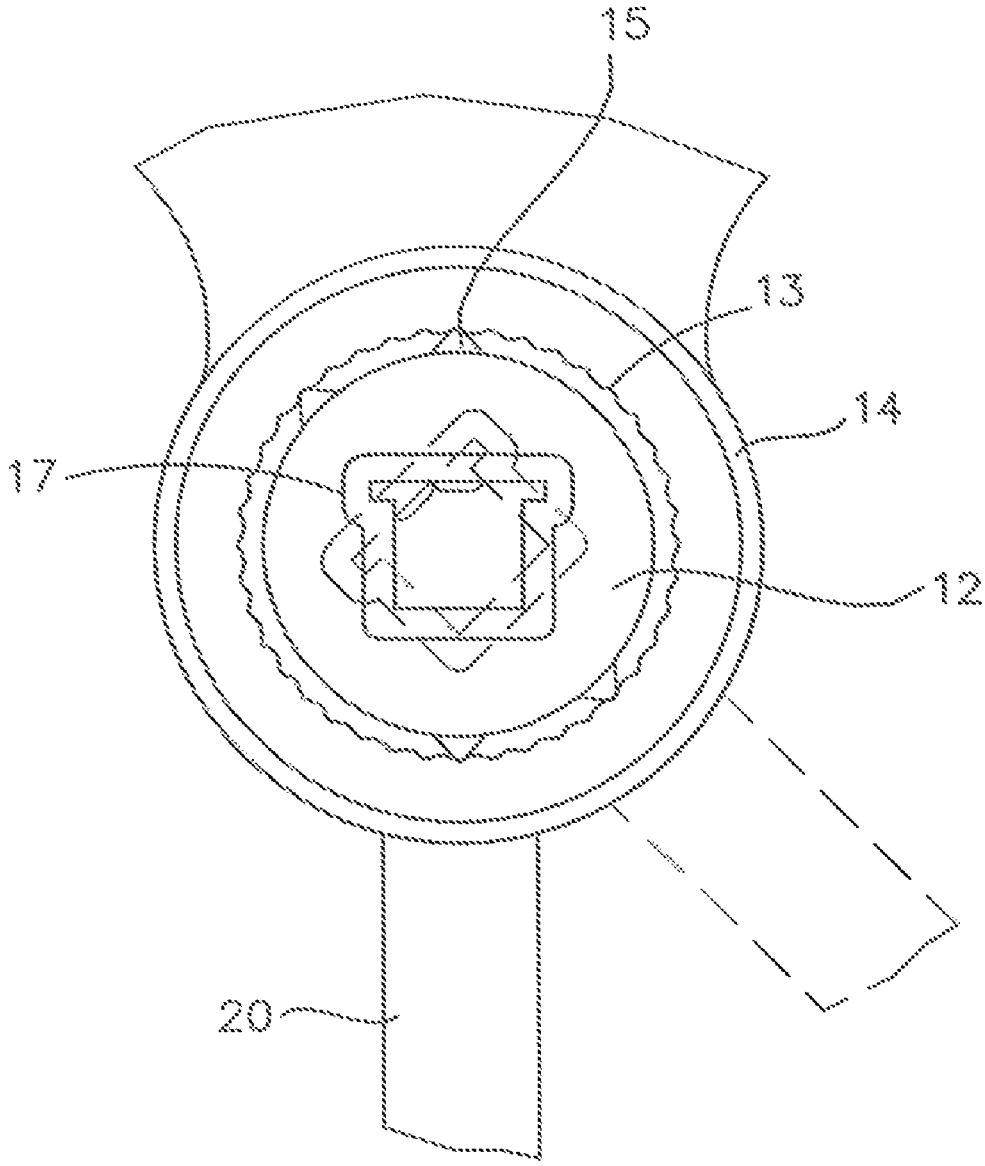
FIG. 5 is a front view of a portion of the suspension tag illustrating the rotation of the fitting cap with respect to a tag body of the suspension tag of the present invention.

When a user wishes to remove the wrench 20 from the suspension tag, the user only needs to cut off the connections 17 of the receiving frame section of the fitting cap 12 by a cutting tool 23, as particularly shown in FIG. 4. With this, the fitting cap 12 is separated into two pieces and the projection 16 (or 161) disengages from the drive piece 21 of the wrench 20 to allow the wrench 20 to separate from the suspension tag. Manually moving the wrench 20 (with respect to the tag) back and forth and/or up and down several times may be needed before the wrench 20 is completely separated from the tag.

To this point, it is apparent that by means of the deformable/displaceable top panel of the receiving frame section and the sloped projection 16 formed on the inside surface of the top panel, the socket wrench 20 can securely retained in the suspension tag for safe exhibition and hanging and accidental separation of the socket wrench off the suspension tag is surely eliminated. The socket wrench can be readily separated from the suspension tag by simply using a cutting tool 23, such as scissors or pliers having sharp edges or blades, to cut off the side connections 17 of the receiving frame. Thus, the present invention provides a secured and easy-to-operate way for safely hanging and exhibiting tools having a form similar to a socket wrench.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I Claim:

1. A suspension tag comprising a tag body and a fitting cap, the tag body having a lower end forming a receptacle seat defining a bore and having an end surface on which a circumferential retention flange is formed to receive insertion of the fitting cap therein in a rotatable and angularly positionable manner, the fitting cap forming a receiving frame section that is made hollow and is configured to be adapted to receive an insertion portion of a tool therein, the receiving frame section comprising a top panel having an inside surface to which a sloped projection is mounted at a location corresponding to and having a shape complementary to a hole defined in the insertion portion of the tool to receive a spring-biased sphere in a partially projecting but retractable manner, and two side panels that are spaced from the top panel and connected thereto by curved side connections to provide displaceability to the top panel with respect to the side panels, wherein when the tool is inserted into the receiving frame section of the fitting cap, the insertion portion of the tool is brought into contact with the sloped projection and thus forcibly displacing and elastically deforming the top panel upward to allow the sloped projection to move to and engage the hole defined in the insertion portion of the tool thereby securely retaining the tool to the suspension tag and wherein to remove the tool from the suspension tag, the side connections are cut off to separate the top panel from the side panels so as to disengage the sloped projection from the hole and thus releasing the insertion portion of the tool from the tag body.

2. The suspension tag as claimed in claim 1, wherein the tag body comprises a plate, which is selectively a regular shape or having a particular configuration and shape.

3. The suspension tag as claimed in claim 1, wherein the fitting cap comprises a plate that is received and fixed inside the fitting cap and the sloped projection is formed on the plate.

4. The suspension tag as claimed in claim 1, wherein the bore of the receptacle seat of the tag body forms a serrated inside circumferential surface.

5. The suspension tag as claimed in claim 1, wherein the fitting cap has a cylindrical section received in the bore of the receptacle seat and wherein the cylindrical section forms an outward-extending rounded projection engageable with a serrated inside circumferential surface of the bore of the receptacle seat.

* * * * *